US005791954A

United States Patent [19]

Johnson, Jr.

[11] Patent Number: 5,791,954

[45] Date of Patent: Aug. 11, 1998

[54] VERTICALLY ADJUSTABLE STERN MOUNTED MARINE DRIVE

[76] Inventor: Nils V. Johnson, Jr., 10309 Wycliff Rd., Richmond, Va. 23236-1933

[21] Appl. No.: 881,475

[22] Filed: Jun. 24, 1997

[51] Int. Cl.[6] ..... B63H 23/36

[52] U.S. Cl. ..... 440/112; 440/63; 440/58; 440/53

[58] Field of Search ..... 441/53, 54, 58, 441/62, 63, 112, 111

[56] References Cited

U.S. PATENT DOCUMENTS 830,908 9/1906 Martin ..... 440/63

FOREIGN PATENT DOCUMENTS 293295 11/1989 Japan ..... 440/54

129453 7/1919 United Kingdom ..... 440/53

*Primary Examiner*—Ed L. Swinehart

[57] ABSTRACT

A stern mounted vertically adjustable propeller and rudder marine drive. The aft end of a propeller shaft, the propeller, the rudder and printle and a skeg are vertically moveable to adjust a boat's draft for use in the water and when trailering. A stern underwater slot in the boat hull and shaped to enhance water flow accommodates the propeller shaft which is driven by an inboard engine. As the propeller shaft passes through the hull slot it engages a flexible water seal mechanism which self adjusts or maintains itself in various up and downward positions; its pivotal point is common with the conterline pivotal point of a universal joint, which is attached to a drive shaft connected to the transmission of an inboard engine.

9 Claims, 3 Drawing Sheets

VERTICALLY ADJUSTABLE STERN MOUNTED MARINE DRIVE

BACKGROUND

This invention relates to a propeller driven vertically adjustable marine drive.

Numerous arrangements have been made for a propeller driven power boat, including inboard engines with an external propeller underneath the boat, outboard engines mounted on the stern of a boat and inboard-outboard engines where an inboard engine is within the boat and a mechanism, such as a Z-drive or outdrive extending beyond the stern of the boat to drive a propeller which is adjustable for steering.

All of these various mechanisms have advantages and disadvantages, but heretofore none of them have provided the advantages of the present mechanism for certain types of boats.

SUMMARY OF THE INVENTION

The present invention is a vertical adjustable stern-mounted marine drive which causes a propeller and its shaft, as well as a rudder downstream from the propeller, to slide up and down as required for best performance in normal water, shallow water performance and a retracted performance.

The boat has an inboard engine which includes transmission which drives an internal fixed universal joint about which one end of a propeller shaft pivots. The propeller shaft extends through the bottom of the boat using a flexible watertight seal and into a tunnel or slot that extends to the stern of the boat. The tunnel is shaped to enhance water flow for various boat comfigurations. The propeller shaft extends beyond the stern through a bearing strut. A rudder is mounted aft of the propeller for movement vertically with the propeller and includes a tiller arm for movement of the rudder to change direction when underway. Fixed to the stern of the boat is an adjustable mechanism, such as a rotating screw, for raising and lowering a sliding device which carries with it a propeller strut, one end of the propeller shaft, the propeller and the rudder and tiller arm. When the boat is being carried by a trailer, the sliding device with propeller, strut, and rudder and tiller arm are recessed in their uppermost position by the adjustment mechanism. However, when the boat is underway in the water, the propeller, strut, propeller shaft and rudder and tiller are in a down position to give the most efficient operation of the boat. When it is desired to go into shallow water, the adjustment mechanism permits the sliding device to assume an intermediate position with the propeller shaft, strut, propeller and rudder and tiller adjusted to minimize the draft of the boat.

While the present prototype boat has been custom made it can be readily appreciated that a suitable production boat, when being manufactured, can have an insert made to define a tunnel at the stern of the boat to accept the moveable propeller shaft and without requiring any substantial retooling of the boat production.

The features, objects and advantages of the invention will become apparent to those skilled in the art from the following detailed description of a preferred embodiment, especially when considered in conjunction with the accompanying drawings in which like numerals in the several views refer to the corresponding parts.

DETAILED DESCRIPTION OF THE PREFERRED EMBODIMENT

Figure 1:
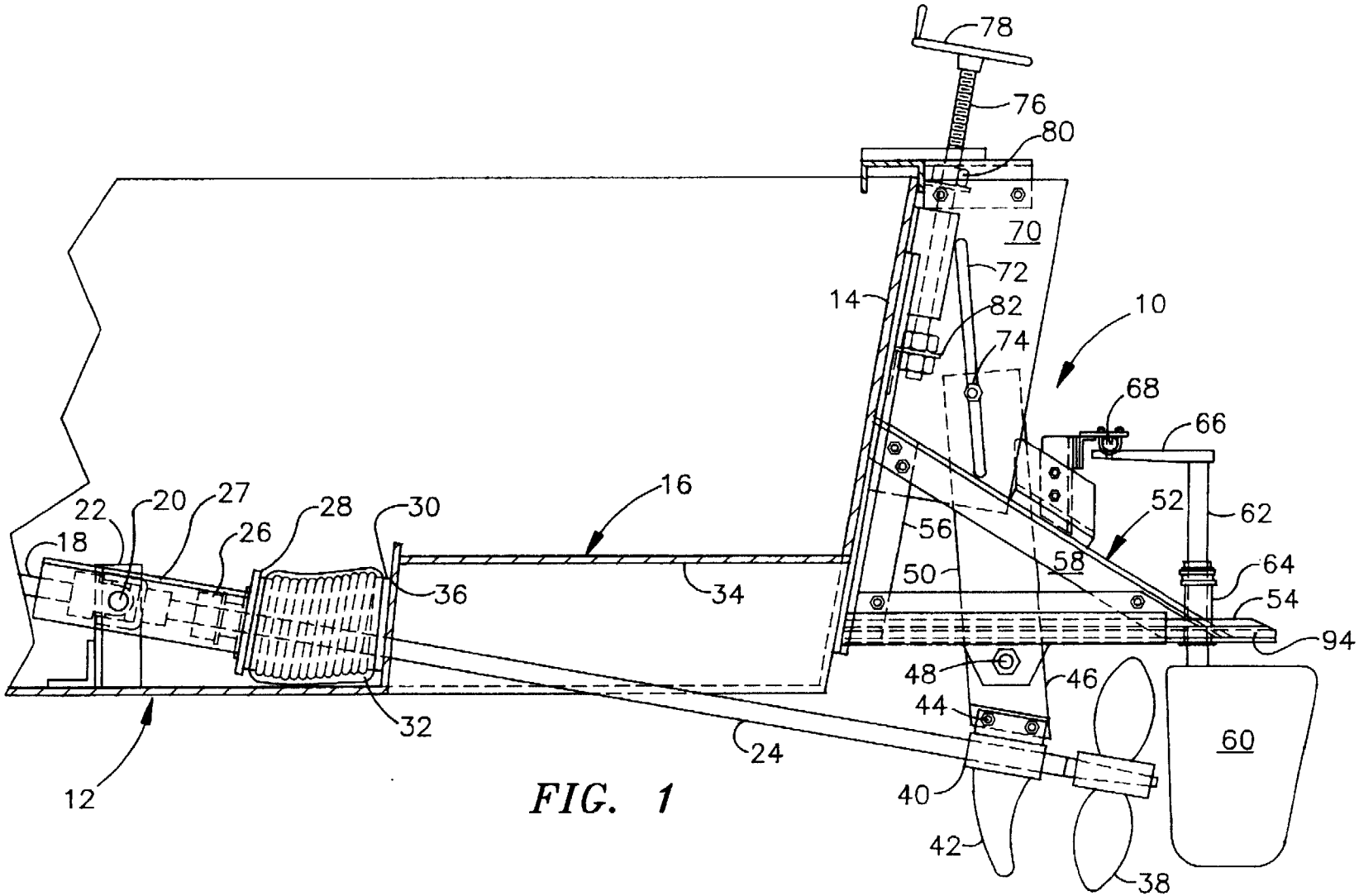
FIG. 1 is a partial side elevational view of the stern of a typical boat with part of the boat in cross-section, to include the vertically adjusted marine drive and sealing mechanism.

With reference to FIG. 1, there is shown a partial cross sectional side view of the invention. Depicted in this view is the vertically adjustable stern mounted marine drive mechanism 10 which is mounted on the stern 14 of the boat 12.

The boat, which is only shown in part, can be modifications of a variety of well known inboard powered propeller driven boats. The boat has a tunnel or hull slot 16 which extends down the center of the boat hull towards the rear for accepting movement up and down of the propeller shaft. The inboard engine which is only shown by means of the inboard engine drive shaft 18 is connected by the drive shaft at its stern end to one side of a universal joint 20. It is to be noted that the inboard engine and the universal joint are carried within the confines of the boat hull.

A propeller shaft 24 has a forward end carried by the other side of universal joint 20 where the propeller shaft is capable of being pivoted in an up and down manner. The stern end of the propeller shaft 24 has mounted thereon a propeller 38 at its aft end. The propeller shaft extends through a water tight through hull stuffing box 26 which is designed to prevent leaks from the water into the hull, but at the same time permits the propeller shaft to rotate within the stuffing box. The stuffing box is mounted to a pivoted bracket 27 which is pivoted to a bracket mount 22 that allows some self alignment movement in a slotted opening (not shown) while maintaining a relative fixed position to the propeller shaft. The stuffing box shown has a flexible hose stuffing box plate 28 mounted at the forward end of a flexible hose 32. The flexible hose 32 has a flexible hose tunnel mounted plate 30 at its stern end which is in a fixed position at the forward end of the tunnel of hull slot 16. The flexible hose may have a transparent cover thereover for detecting leaks.

With reference to the tunnel 16, there is a top of the tunnel 34 and a front wall of the tunnel or slot 36 to accommodate the propeller shaft 24.

The stern end of the propeller shaft 24 extends beyond the stern of the boat as shown in FIG. 1 so that near its aftermost end just prior to the propeller there is provided a strut 40 having a marine bearing that permits the shaft to rotate within the bearing. A skeg 42 is provided below the strut. The strut 40 is held fixed to a strut support plate 46 by means of bolts 44. A pivot bolt 48 connects the strut support plate 46 to a strut alignment plate 50 to provide a pivoted connection which will be discussed further below.

There is a vertical moveable base 52 made of horizontal base member 54, vertical base member 56 and diagonal base member 58. The three components of the vertical moveable base move together.

Mounted at the stern end of the horizontal base member 54 and just to the rear of the propeller 38 is a rudder 60 which is carried by a vertical rudder shaft 62 that pivots within a rudder shaft support bracket 64 attached to the horizontal base member 54. At the top end of the rudder shaft there is carried a tiller arm 66 which is actuated by a tiller actuator 68. The actuator can be of many known kinds such as a cable or other mechanism.

It is to be noted that the vertical moveable base 52 carries with it a strut alignment plate 50, the aft end of propeller shaft 24, the strut 40, propeller 38, strut support plate 46, rudder 60, rudder shaft support bracket 64, rudder shaft 62, tiller arm 66 and tiller actuator 68 at it moves vertically from its bottom most position to its top most position.

The outside of stern 14 has a strut alignment guideplate 70 having a vertical slot 72 in which a moveable pin 74 carried by strut alignment plate 50 is caused to ride up and down during any adjustments. The vertical adjustment is carried out by a threaded screw 76 rotated by a wheel 78 through a fixed mount 80 mounted on the boat and a moveable mount 82 attached to a slidable plate 84. This arrangement causes said turning screw to hold its position when no force is applied to the wheel. Other veritcal adjustment arrangements such as hydraulic cylinders may also be used.

Figure 2:
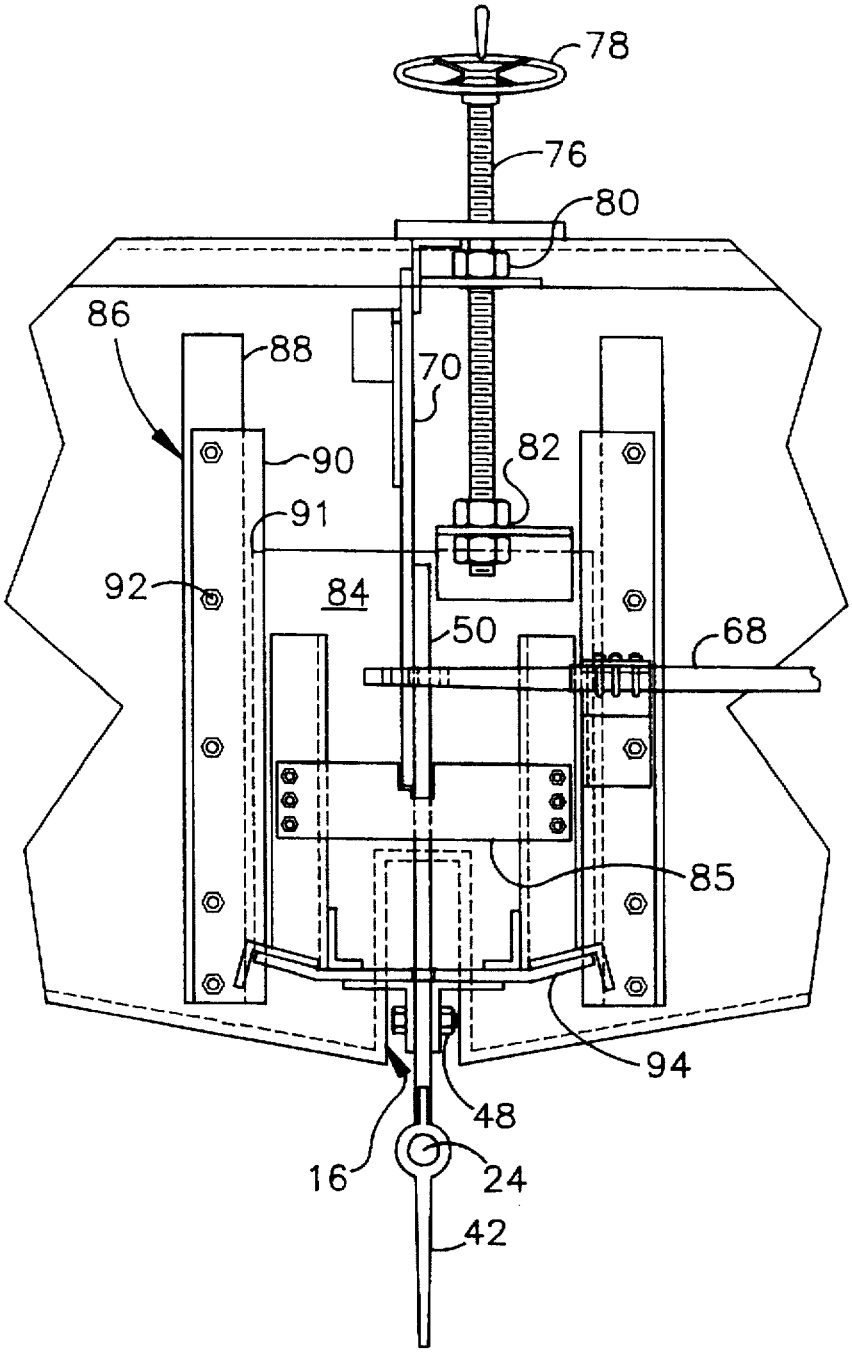
FIG. 2 is a stern view of the marine drive mechanism mounted on a breakaway view of the boat hull just forward of the rudders the propeller is not shown for clarity.

With reference to FIG. 2 there is shown a stern view of a cut-away portion of the boat just forward of the rudder, the propeller not being shown for clarity. In FIG. 2 the vertically adjustable slideable plate 84 can be seen which is adjusted vertically through a bracket carrying the moveable mount 82 which is attached to slideable plate 84.

The slideable plate has alignment tracks 86 on each side thereof, only one of which will be mentioned herein with the understanding the other alignment track is similar thereto.

There is provided a spacer 88 which spaces the plate retainer 90 so as provide a clearance between the stern of the boat and the plate retainer 90 to permit the slideable plate to move vertically. It is to be understood that the spacer 88 can be built into the stern of the boat. The plate retainer 90 is affixed to the stern by means of bolts 92. The side edges of slideable plate 84 are in the space underneath the inboard edges of the plate retainer 90. Also, the spacer and plate retainer could be a single extension or built from weldments. Also shown in FIG. 2 is a water flow plate 94 that permits an easy transition of water from under the boat hull to the rear.

In the interest of clarity, moveable pin 74 is not shown in FIG. 2.

Slotted plate 85 provides lateral stability to strut alignment plate 50 to help prevent vibration.

Figure 3:
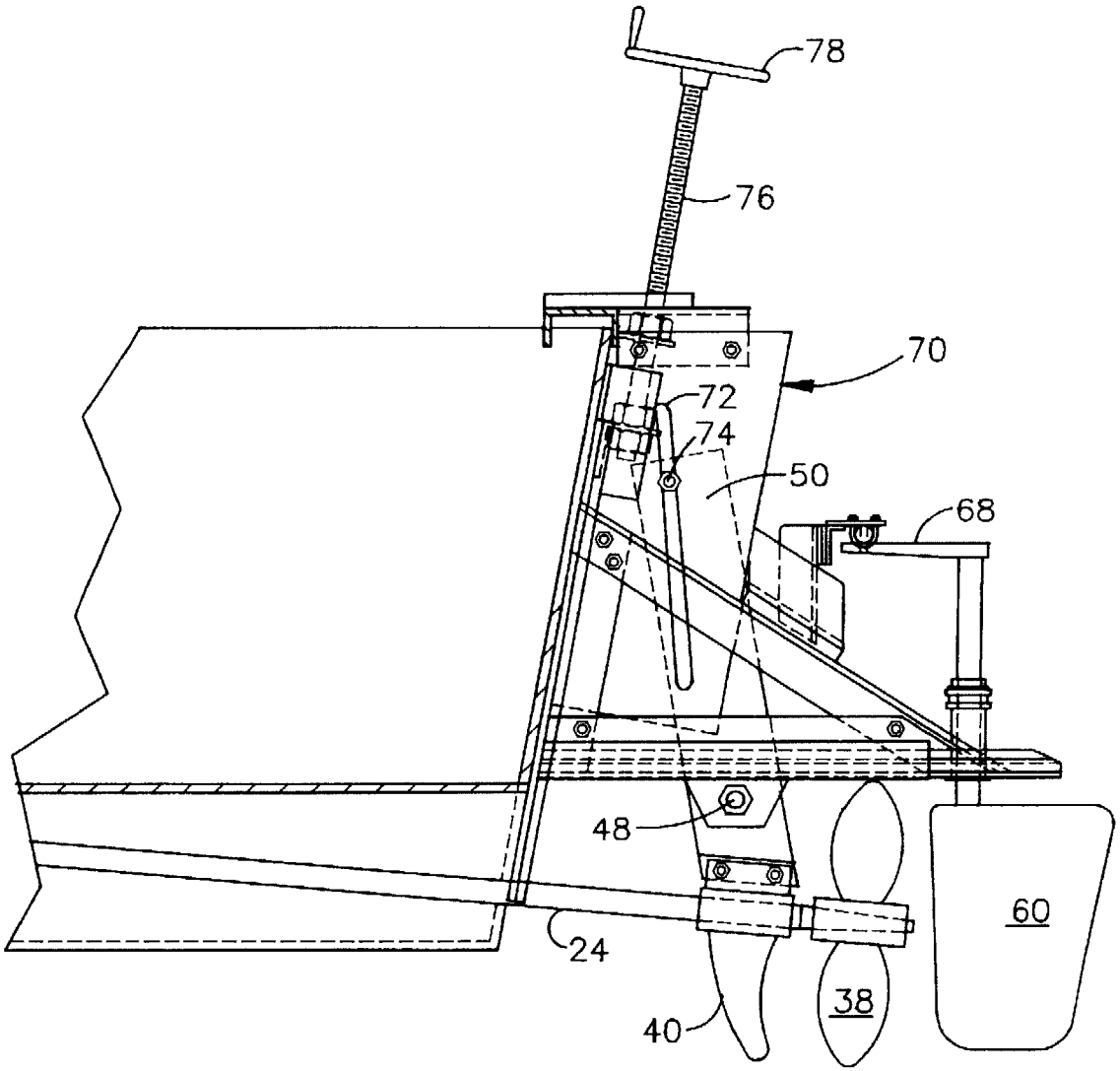
FIG. 3 is a view similar to FIG. 1 but showing the rear end of the propeller shaft, strut, propeller, and rudder and tiller adjusted to an upward position.

With reference to FIG. 3, there is shown a partially sectional view of the stern of the boat where the propeller shaft, strut, propeller, and rudder and pintle are raised to an intermediate position relative to the lower position of FIG. 1. There is a greater clearance between the top of the propeller and water flow plate than shown.

As used within this specification the term "vertical" is used in a general sense to define an up and down movement and is not meant to be a 90 degree angle to the horizontal as can be recognized by reference to the drawings in this application. This vertical movement shown may be done at a partial angle to the vertical. Other examples of vertical movement could be more directly up and down.

The invention has been described herein as a sliding device connected to the stern of an inboard engine powered boat connected by a universal joint with a propeller shaft that passes through the boat through a water tight stuffing box into a tunnel which extends to the stern of the boat through a vertical moveable strut, propeller, rudder pintle and propeller shaft are raised and lowered as needed. The sliding device allows a vertical range of motion and holds securely in place the pivoting propeller shaft and a rudder. The strut bracket, which holds the propeller shaft, is uniquely designed and constructed to keep the propeller shaft bearing perpendicular to the shaft regardless of the up or downward position of the sliding device, with upmost reliability. The flexible water tight stuffing box and bracket allows vertical motion of the propeller shaft as the propeller shaft passes through the boat hull and in turn prevents water from leaking into the boat.

The basic advantages of the invention include a sliding device which in its upward postion provides for easier loading of a boat on a boat trailer, since the rudder and propeller will have less chance to drag during the operation. Also, easier trailing of the boat when mounted on the trailer can give a lower center of gravity without the rudder or propeller dragging on the road surface. Still further, the boat may be propelled through very shallow water, almost to the limiting draft of the boat and at the same time when there is no limiting draft, the propeller and rudder can be positioned in the most efficient lowered position.

With the sliding device and various downward positions, the power of the boat may be optimized for various wind and water conditions and speed at various RPMs; which can directly relate to the economical costs of operating the boat.

As seen in the drawings the forward end of the propeller shaft is pivoted about universal joint 20 at the forward end and is raised and lowered at the stern end along with the other moveable components during the raising and lowering operation.

The invention has been described herein to provide those skilled in the art with the information needed to apply its features and to utilize such components as are required. However, it is to be understood that the invention can be carried out by specifically different mechanisms without departing from the scope of the invention itself.

claim:

1. An adjustable stern mounted marine drive comprising:

a boat having a hull and a vertical stern and hull;

an inboard engine for said boat having a drive shaft with an outboard end;

a universal joint located inside said boat connected at one end to said outboard end;

a propeller shaft having an inboard end and an aft end and extending through said hull to aft of said stern of said boat;

a flexible watertight seal through which said propeller shaft passes through said hull;

a propeller mounted at said aft end of said propeller shaft;

a tunnel located on the underside of said hull aft of said seal in which said propeller shaft can be moved vertically;

a strut for supporting said aft end of said propeller shaft;

a fixed base affixed to said stern;

a vertically extending strut alignment guide plate affixed to said fixed base;

an adjustment mechanism affixed to said fixed base;

vertical guide rails affixed to said fixed base;

a sliding member for vertical movement in said guide rails;

a moveable base attached to said sliding member;

a rudder and pintle carried by said moveable base;

a strut alignment follower plate;

a pivot point connected to said strut and connected at its upper end to said strut alignment follower plate; and an alignment arrangement in said strut alignment guide plate for guiding said strut alignment follower plate whereby said aft end of said propeller shaft, said propeller, said strut, and said rudder and pintle are carried by said moveable base as they are raised and lowered by said adjustment mechanism.

2. The drive of claim 1 wherein said adjusting mechanism is a vertical screw with a wheel at one end for turning said screw and attached at the other end to said sliding member to move said sliding member up and down and hold its position when no further force is applied to said wheel.

3. The drive of claim 1 wherein a water flow plate is carried by said moveable base.

4. The drive of claim 1 wherein said strut alignment guide plate is a slot and said alignment mechanism in said strut alignment follower plate is a pin riding in said slot.

5. An adjustable stern mounted marine drive comprising:

a propeller shaft having an inboard end and an aft end;

a propeller mounted at said aft end of said propeller shaft;

a strut for supporting said aft end of said propeller shaft;

a fixed base for affixing to a boat's stern;

a vertically extending strut alignment guide plate affixed to said fixed base;

an adjustment mechanism affixed to said fixed base;

vertical guide rails affixed to said fixed base;

a sliding member for vertical movement in said guide rails;

a moveable base attached to said sliding member;

a rudder and pintle carried by said moveable base;

a strut alignment follower plate;

a pivot point connected to said strut and connected at its upper end to said strut alignment follower plate; and an alignment arrangement in said strut alignment guide plate for guiding said strut alignment follower plate whereby said aft end of said propeller shaft, said propeller, said strut, and said rudder and pintle are carried by said moveable base as they are raised and lowered by said adjustment mechanism.

6. The drive of claim 5 wherein said adjusting mechanism is a vertical screw with a wheel sheet at one end for turning said sliding member up and down and hold its position when no further force is applied to said wheel.

7. The drive of claim 5 wherein a water flow plate is carried by said moveable base.

8. The drive of claim 5 wherein said strut alignment guide plate is a slot and said alignment mechanism in said strut alignment follower plate is a pin riding in said slot.

9. An adjustable stern mounted marine drive comprising:

a boat having a hull and a vertical stern and hull;

an inboard engine for said boat having a drive shaft with an outboard end;

a universal joint located inside said boat connected at one end to said outboard end;

a propeller shaft having an inboard end and an aft end and extending through said hull to aft of said stern of said boat;

a flexible watertight seal through which said propeller shaft passes through said hull;

a bracket for said seal;

a first member affixed to said forward end of said tunnel;

a second member affixed to said bracket;

a flexible hose extending from said first member to said second member through which said propeller shaft passes;

a propeller mounted at said aft end of said propeller shaft;

a tunnel having a forward end located on the underside of said hull aft of said seal in which said propeller shaft can be moved vertically;

a strut for supporting said aft end of said propeller shaft;

a fixed base affixed to said stern;

a vertically extending strut alignment guide plate affixed to said fixed base;

an adjustment mechanism affixed to said fixed base;

vertical guide rails affixed to said fixed base;

a sliding member for vertical movement in said guide rails;

a moveable base attached to said sliding member;

a rudder and pintle carried by said moveable base;

a strut alignment follower plate;

a pivot point connected to said strut and connected at its upper end to said strut alignment follower plate.

* * * * *